US005428847A

United States Patent [19]

Atkins et al.

[11] Patent Number: 5,428,847

[45] Date of Patent: Jul. 4, 1995

[54] DRAIN ASSEMBLY

[75] Inventors: Edwin F. Atkins, Wethersfield; Corrado Mangiafico, Middletown, both of Conn.

[73] Assignee: The Kenney Manufacturing Company, Newington, Conn.

[21] Appl. No.: 242,732

[22] Filed: May 13, 1994

[51] Int. Cl.[6] ..... A47K 1/14

[52] U.S. Cl. ..... 4/295

[58] Field of Search ..... 4/286, 287, 295

[56] References Cited

U.S. PATENT DOCUMENTS

| | | | |
|---|---|---|---|
| 1,760,659 | 5/1930 | Pasman | 4/287 |
| 3,366,980 | 2/1968 | Petursson et al. | 4/295 |
| 4,369,531 | 1/1983 | Swanson | 4/295 |
| 4,597,112 | 7/1986 | Cuschera | 4/295 X |
| 4,876,749 | 10/1989 | Antoniello | 4/295 |
| 4,908,883 | 3/1990 | Rivera | 4/295 |
| 4,926,507 | 5/1990 | Craig et al. | 4/295 |

*Primary Examiner*—Charles E. Phillips

*Attorney, Agent, or Firm*—Chilton, Alix & Van Kirk

[57] ABSTRACT

A drain assembly includes a drain body, a sleeve, a shaft and a plug. The drain body has an axial bore and a transverse cruciform web mounted in the bottom of the bore. The sleeve has an axial bore that is substantially coaxial to the drain body bore. The exterior surface of the sleeve bottom end portion is threaded for engagement with a threaded aperture in the drain body web. The shaft is slidably disposed within the sleeve bore and is retained in the sleeve by a clip. The plug has a threaded axial blind bore for engagement with the threaded outer surface of the shaft top portion and a frustum-like circumferential surface that engages the drain body seating surface to seal the drain body bore. An integral handle longitudinally extending from the top of the plug provides a means for grasping the plug to axially displace the plug to open or close the assembly.

19 Claims, 2 Drawing Sheets

DRAIN ASSEMBLY

BACKGROUND OF THE INVENTION

This invention relates generally to apparatus for controlling the discharge of water or other liquids from a container. More particularly, the present invention is directed to a drain assembly for bathtubs, sinks and the like.

Drain assemblies are well known and generally comprise two types. The first type utilizes separate components such as a drain seat and a rubber plug. The plug is manually inserted into the drain seat, sealing the drain at the seating surface. Such drain assemblies are subject to several problems. The rubber plug is not attached to the assembly and may be lost. The rubber plug is subject to wear and damage. A worn or damaged plug may not provide a tight seal with the seating surface, allowing water to drain from the bathtub. The plug may be seated too forcefully, making it difficult or impossible to remove the plug without damage to the plug and or seating surface.

The second type utilizes an integral assembly which comprises a drain seat and a metal plug. A lever mechanism or equivalent actuator is employed to seat and unseat the metal plug. Such lever operated actuators are difficult or impossible to repair or replace should they become damaged or inoperable due to wear or loss of parts. Additionally such drain assemblies may not be suitable for bathtubs or sinks that were not designed for their use. Alternatively, in drains of the second type, the metal plug may have a "handle" that is used to manually position the plug. The drain assembly shown in U.S. Pat. No. 4,926,507, for example, employs the arms of a U-shaped metallic spring to frictionally grip opposed flats on a center post that projects from the plug bottom. The frictional force holds the plug in the selected plug position. Wear between the spring and post flats can reduce the frictional force, preventing the spring from holding the plug in an open position. As a further disadvantage of this type of drain assembly, the plug is often provided with a resilient seal member which is subject to relatively rapid wear and is difficult or impossible to replace.

SUMMARY OF THE INVENTION

Briefly stated, the present invention in a preferred form is a drain assembly particularly well suited for use in a bathtub. The drain assembly includes a drain body, a sleeve, a shaft and a plug. The drain body has an axial bore, a conical seating surface, and a transverse cruciform web mounted in the bore at the drain body bottom end. The sleeve has an axial bore that is substantially coaxial to the drain body bore. The exterior surface of the sleeve bottom end portion is threaded for engagement with a threaded aperture in the drain body web. The shaft is slidably disposed within the sleeve bore. The shaft bottom portion has a circumferential groove. A clip is mounted in the groove after the shaft is inserted into the sleeve, thereby locking the shaft to the sleeve. The plug has a threaded axial blind bore, which engages the threaded outer surface of the shaft top portion and a frustum-like circumferential surface, which engages the drain body seating surface to seal the drain body bore. An integral handle, longitudinally extending from the top of the plug, provides a means for grasping the plug to axially displace the plug to open or close the assembly. A steel ball bearing is mounted in a transverse blind bore in the shaft and is biased towards the sleeve bore surface by a spring. The resiliently biased ball provides sufficient frictional force to hold the plug in any axial position.

The drain body and plug are chrome plated. The smooth chrome plated surfaces of the drain body seating surface and the complementary plug circumferential surface provide a tight seal. Additionally, these surfaces are hard and corrosion resistant and therefore are resistant to damage that might compromise the seal. Drain assemblies in accordance with the invention may be designed and manufactured to fit a variety of bathtub and sink designs. The present assembly is self-contained and may be used to replace drain assemblies of the prior art types described above.

An object of the invention is to provide a new and improved drain assembly characterized by a long and trouble free service life.

Another object of the invention is to provide a drain assembly having a plug that is resistant to damage and corrosion.

A further object of the invention is to provide a drain assembly that may be utilized to replace both types of current drain assemblies.

Other objects and advantages of the invention will become apparent from the drawings and specification.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DETAILED DESCRIPTION OF THE PREFERRED EMBODIMENT

Figure 1:
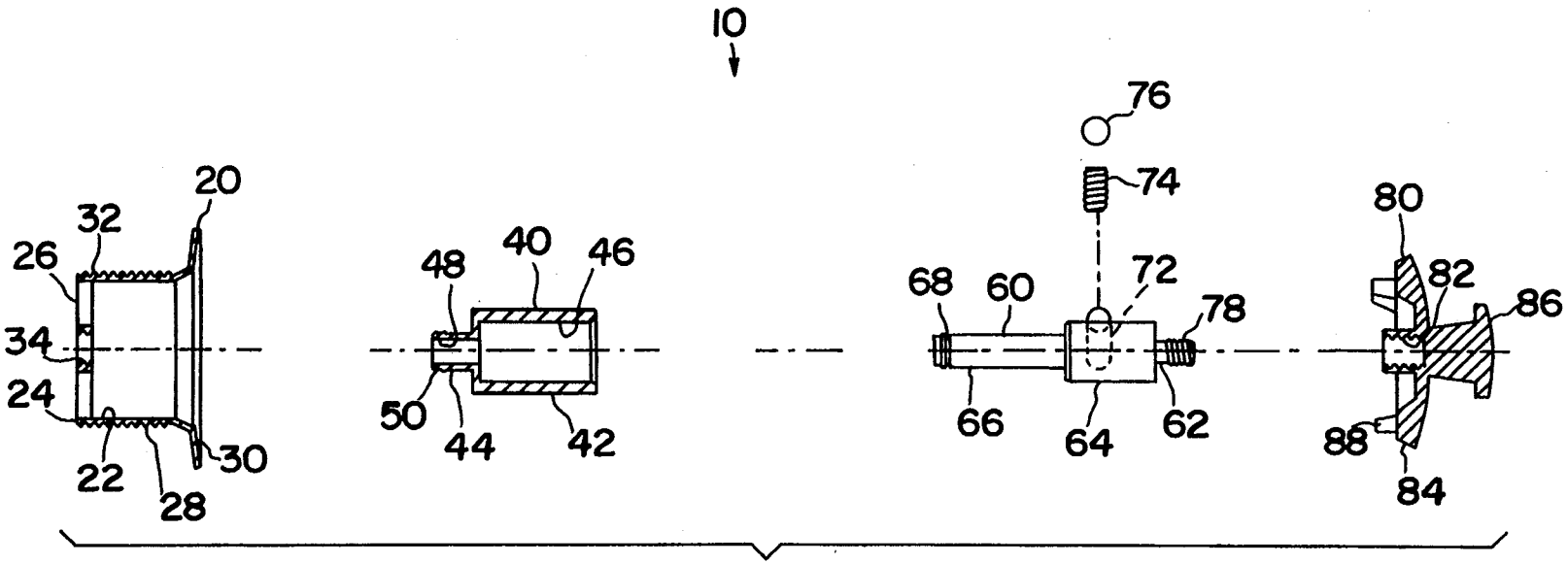
FIG. 1 is an exploded cross sectional view of a drain assembly in accordance with the present invention.

With reference to the drawings, wherein like numerals represent like parts throughout the several figures, a drain assembly in accordance with the present invention is generally designated by the numeral 10. The drain assembly 10 is comprised of a conduit defining drain body 20, a sleeve 40, a shaft 60 and a plug 80. In a preferred embodiment the drain assembly components are composed of brass and the drain body 20 and plug 80 are chrome plated.

The drain body 20 defines a conduit 22. At its bottom end 24, the drain body has a cruciform web 26 which extends across conduit 22. Drain body 20 also has an exterior surface 28 and an upper seating surface 30. Preferably, the exterior surface 28 is threaded, as indicated at 32, for engagement with the bathtub and drain pipe (not shown). The web 26 has an internally threaded orifice 34 that is coaxial with the conduit 22.

The sleeve 40 consists of a main or larger diameter upper sleeve 42 and a smaller diameter sleeve extension 44. The main sleeve 42 and the sleeve extension 44 each define longitudinal, coaxial bores 46, 48. In a preferred embodiment the sleeve extension bore 48 has a smaller diameter than the main sleeve bore 46. The sleeve extension 44 has a threaded exterior surface 50 for engagement with the drain body web orifice 34.

Figure 2:
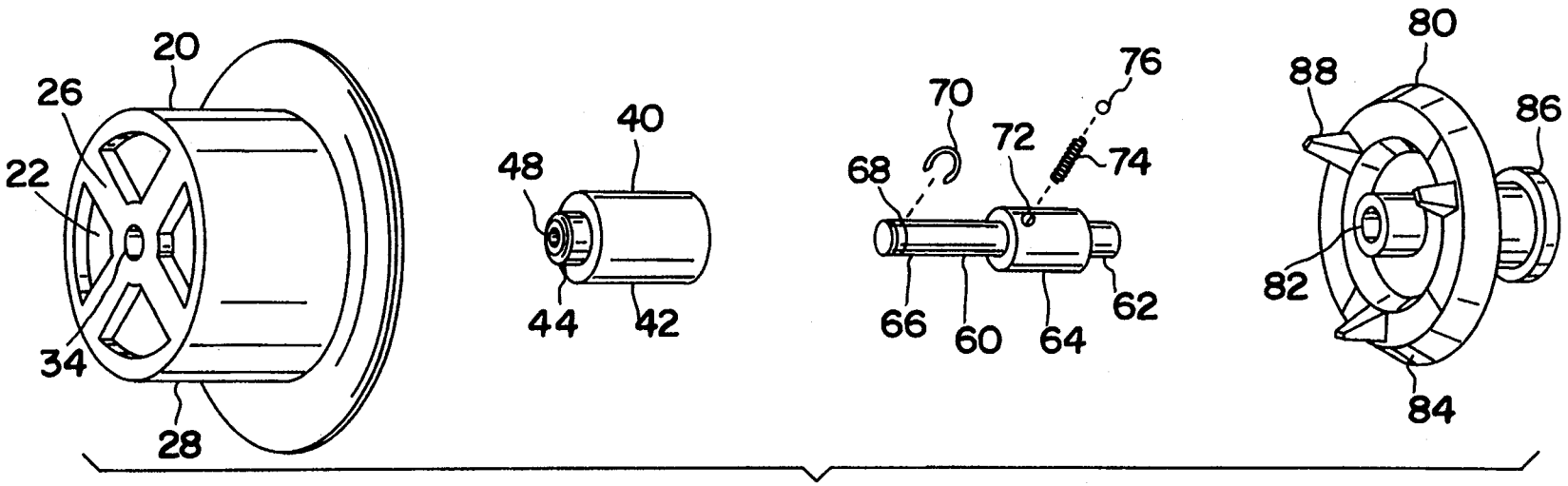
FIG. 2 is an exploded perspective view of the drain assembly of FIG. 1.

The shaft 60 has top, intermediate and bottom portions 62, 64, 66. In the preferred embodiment the outside diameter of the intermediate section 64 is larger than the outside diameter of the top and bottom portions 62, 66. The diameters of the bottom and intermediate portions 66, 64 are such that bottom and intermediate portions 66, 64 are slidably received in the sleeve extension bore 48 and main sleeve bore 46 respectively. The bottom portion 66 of shaft 60 has a circumferential groove 68. A clip 70 (FIG. 2) engages groove 68 after the shaft 60 is inserted in the sleeve 40. The outside diameter of the clip 70 is greater than the diameter of the sleeve extension bore 48 whereby the shaft 60 is slidably captured in the sleeve 40. The intermediate portion 64 has a transverse blind bore 72. A coil-type compression spring 74 and a steel ball 76 are mounted in the transverse bore 72. The spring 74, which is of a highly reliable and long lasting design, biases the ball 76 into contact with the inside surface of the main sleeve bore 46. In operation, no lateral forces are applied to spring 74 and ball 76 is able to rotate thus extending its service life. The top portion 62 of shaft 60 has a threaded exterior surface portion 78.

The plug 80 has a threaded axial blind bore 82 for engagement with the threaded shaft top portion 78 of shaft 60. The plug 80 has a frustum-like circumferential surface 84 that engages the conically shaped drain body seating surface 30 to seal the drain body bore 22. An integral handle 86 provides a means for grasping the plug to axially displace the plug to open or close the assembly 10. A plurality of legs 88 longitudinally extend from the plug bottom surface 90. The legs 88 are received by the drain body bore 22 and help guide the plug during axial movement.

The contact between the spring biased steel ball 76 and the wall of bore 46 provides sufficient frictional force to maintain the plug 80 in any manually selected axial position, including the fully open position. The shaft 60 is free to rotate within the bore 46, thus further preventing excessive wear between the steel ball 76 and the wall of the bore 46. The smooth chrome plated surfaces of the seating surface 30 and the plug circumferential surface 84 provide a tight seal, preventing discharge of the bathtub water. Additionally, these surfaces are hard and are not subject to corrosion and therefore are resistant to damage that might compromise the seal. The assembly 10 is self-contained and may be manufactured in a variety of drain body sizes such that it may replace existing drain assemblies.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. An improved drain assembly comprising:

drain body means defining a conduit having a peripheral seating surface at the top end thereof, said drain body means having a bottom end, a web member bridging said conduit at said bottom end, said web member having a bore therethrough, said bore having a diameter;

sleeve means, said sleeve means defining a first bore, said sleeve means having a bottom end, said sleeve means bottom end portion defining a second bore, said first and second bores and said web member bore being coaxial, the diameter of said second bore in said sleeve means being less than the diameter of said bore in said web member, said sleeve means and sleeve means bottom portion each having an outside diameter, said bottom portion outside diameter being less than said sleeve means diameter, said sleeve means further comprising means for connecting said bottom end portion to said drain body means web member;

shaft means slidably disposed in said sleeve means bore; and plug means having a seating surface complementary in shape to said drain body means seating surface, said plug means further comprising handle means and means for connecting said plug means to said shaft means top portion, said plug means being axially displaceable to and from a closed position wherein said plug means seals said drain body conduit at said drain body top end.

2. The drain assembly of claim 1 wherein said shaft means includes:

means for resiliently engaging said sleeve means defined first bore to frictionally hold said plug means at any desired position relative to said drain body means seating surface.

3. The assembly of claim 1 wherein said plug means has a bottom surface, said plug means further comprising three legs longitudinally extending from said bottom surface wherein said legs are received by said drain body means bore.

4. The drain assembly of claim 1 wherein said shaft means comprises intermediate, top and bottom portions, said shaft means portions each having an outside diameter wherein said shaft means intermediate portion diameter is greater than said shaft means bottom portion diameter and said shaft means top portion diameter, said shaft means intermediate portion diameter being less than said sleeve means first bore diameter and greater than said sleeve means second bore diameter, said shaft means bottom portion diameter being less than said sleeve means second bore diameter, wherein said shaft means bottom portion is received in said sleeve means second bore and said shaft means intermediate portion is received in said sleeve means first bore.

5. The assembly of claim 4 wherein said shaft means bottom portion comprises a circumferential groove and a clip having a diameter greater than said sleeve means second bore diameter, wherein said clip is disposed in said groove after said shaft means bottom portion is inserted in said sleeve means second bore.

6. The assembly of claim 5 wherein said shaft means intermediate portion comprises a radial bore, a spring and a ball and said sleeve means first bore comprises a surface, said spring and ball being disposed in said radial bore, said spring biasing said ball against said sleeve means first bore surface.

7. The assembly of claim 1 wherein said drain body means peripheral seating surface defines a frustoconical-shaped seat.

8. The assembly of claim 7 wherein said plug means has a circumferential surface, said surface defining a frustum wherein said circumferential surface and said seat seal said drain body means bore.

9. The assembly of claim 1 wherein said drain body means has an exterior surface, said drain body means exterior surface being threaded.

10. The assembly of claim 1 wherein said drain body means, said sleeve means, said shaft means and said plug means are composed of brass.

11. The assembly of claim 10 wherein said drain body means and said plug means are plated with chrome.

12. An improved drain assembly for a bathtub, the assembly comprising:

drain body means, said drain body means defining an axial bore, said drain body means having a bottom end and a web member transversely disposed in said bore at said bottom end, said web member having a bore coaxial to said drain body means bore, said web member bore having a threaded surface;

sleeve means, said sleeve means defining a first bore having a diameter, said sleeve means having top and bottom ends and a sleeve extension longitudinally extending from said bottom end, said sleeve extension defining a second bore, said second bore having a diameter that is less than said first bore diameter, said sleeve extension having a threaded exterior surface wherein said sleeve extension is threadably connected to said web bore;

shaft means having bottom, intermediate, and top portions, said shaft means portions each having a diameter wherein said shaft means intermediate portion diameter is greater than said shaft means bottom portion diameter and said shaft means top portion diameter, said shaft means intermediate portion diameter being less than said sleeve means first bore diameter and greater than said sleeve means second bore diameter, said shaft means bottom portion diameter being less than said sleeve means second bore diameter, wherein said shaft means bottom portion is received in said sleeve means second bore and said shaft means intermediate portion is received in said sleeve means first bore, said shaft means top portion having a threaded exterior surface, said shaft means intermediate portion being provided with a radial bore;

plug means threadably connected to said shaft means top portion, said plug means having handle means whereby said plug means is axially displaceable to and from a closed position wherein said plug seals said drain body bore at said drain body top end; and a spring and a ball disposed in said radial bore, said spring biasing said ball against said sleeve means first bore surface.

13. The assembly of claim 12 wherein said plug means has a bottom surface, said plug means further comprising three legs longitudinally extending from said bottom surface wherein said legs are received by said drain body means bore.

14. The assembly of claim 12 wherein said drain body means bore comprises an upper section, said upper section defining a conical seal seat.

15. The assembly of claim 12 wherein said plug means has a circumferential surface, said surface defining a frustum wherein said circumferential surface and said seat seal said drain body means bore.

16. The assembly of claim 12 wherein said shaft means bottom portion comprises a circumferential groove and a clip having a diameter greater than said sleeve means second bore diameter, wherein said clip is disposed in said groove after said shaft means bottom portion is inserted in said sleeve means second bore.

17. The assembly of claim 12 wherein said drain body means has an exterior surface, said drain body means exterior surface being threaded for engagement with the bathtub.

18. The assembly of claim 12 wherein said drain body means, said sleeve means, said shaft means and said plug means are composed of brass.

19. The assembly of claim 18 wherein said drain body means and said plug means are plated with chrome.

* * * * *

UNITED STATES PATENT AND TRADEMARK OFFICE

CERTIFICATE OF CORRECTION

PATENT NO. : 5,428,847

DATED : July 4, 1995

INVENTOR(S) : Edwin F. Atkins et al

It is certified that error appears in the above-indentified patent and that said Letters Patent is hereby corrected as shown below:

On the front page at item [73], change "Kenney" to --Keeney--.

Signed and Sealed this

Nineteenth Day of November, 1996

Bruce Lehman

*Attest:*

BRUCE LEHMAN

*Attesting Officer*

*Commissioner of Patents and Trademarks*